United States Patent [19]

Stefan

[11] Patent Number: 4,828,342

[45] Date of Patent: May 9, 1989

[54] CONVERTIBLE COMPUTER DESK

[76] Inventor: Alexander Stefan, 216 E. Arby Ave., Las Vegas, Nev. 89119

[21] Appl. No.: 252,895

[22] Filed: Oct. 3, 1988

[51] Int. Cl.[4] ..... A47B 81/00

[52] U.S. Cl. ..... 312/21; 312/208; 312/306; 312/312; 108/86

[58] Field of Search ..... 312/21, 312, 240, 241, 312/208, 306; 108/93, 86

[56] References Cited

U.S. PATENT DOCUMENTS

| | | | |
|---|---|---|---|
| 427,217 | 5/1890 | Bancroft | 312/21 |
| 2,240,551 | 5/1941 | Cooper | 108/86 |
| 3,794,398 | 2/1974 | Lindsay | 312/241 |
| 4,145,097 | 3/1979 | Naess et al. | 312/208 X |
| 4,735,467 | 4/1988 | Wolters | 312/21 X |
| 4,755,009 | 7/1988 | Price et al. | 312/208 X |

FOREIGN PATENT DOCUMENTS

| | | | |
|---|---|---|---|
| 258026 | 3/1913 | Fed. Rep. of Germany | 312/21 |
| 872393 | 7/1949 | Fed. Rep. of Germany | 312/21 |

*Primary Examiner*—Joseph Falk
*Attorney, Agent, or Firm*—Charles C. Corbin

[57] ABSTRACT

Disclosed is a convertible computer desk with a construction that allows it to convert from a conventionally appearing desk into a configuration in which computer equipment, such as a monitor and related equipment, is raised to desktop level from internal storage and a keyboard is exposed. A pair of upright, space-apart support walls extend from the front to the rear of the desk and are provided with tracking means along their upper portions, and a concealable keyboard support shelf extends between forward parts of the support walls. A storage compartment located between the support walls holds an elevatable equipment platform for raising equipment from within the compartment to desktop level. A pair of rectangular desktop panels are mounted to the tracking means in a manner which allows them to be manipulated during conversion from one desk configuration to another.

3 Claims, 2 Drawing Sheets

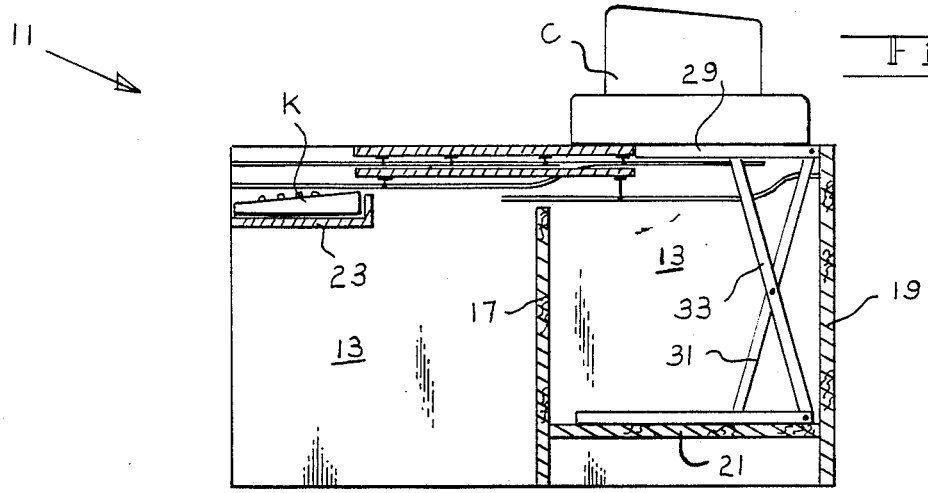
Fig. 4
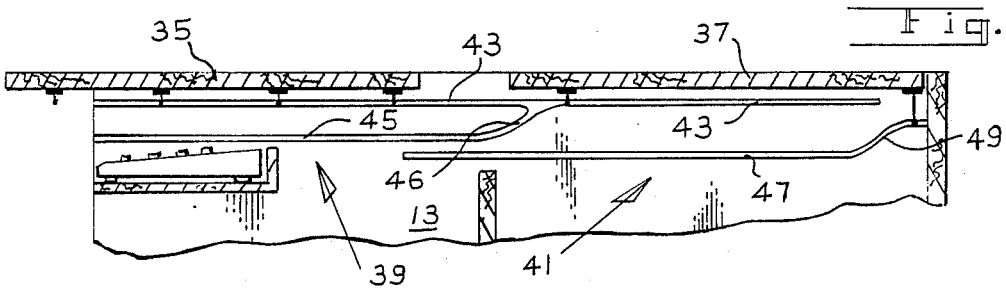
Fig. 5
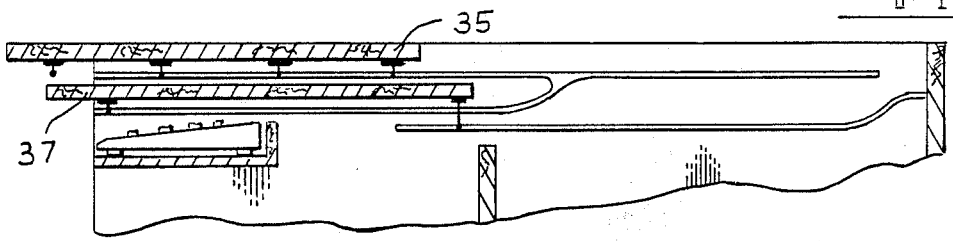
Fig. 6
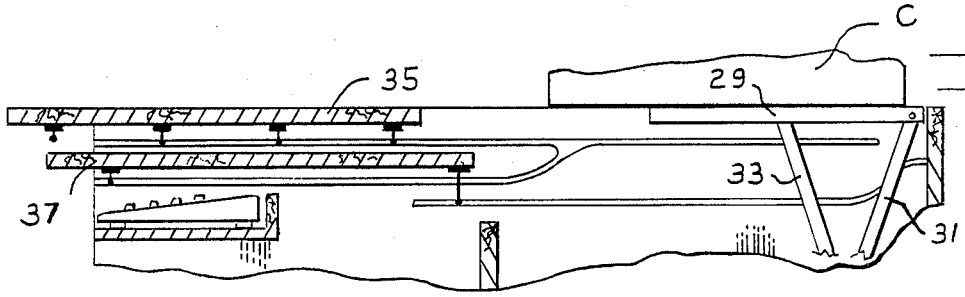
Fig. 7
Fig. 8
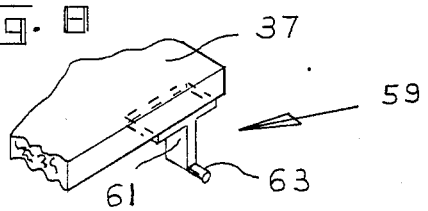
Fig. 9
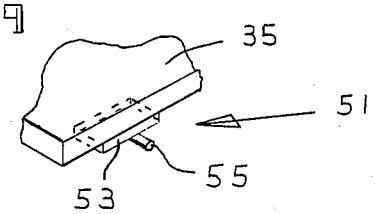

CONVERTIBLE COMPUTER DESK

BACKGROUND

This invention relates generally to desks and more particularly to a desk having a convertible desk top.

The growth and popularity of computers in industry, business and the home has spurred the quest for improvements in the design of computer work stations. Consequently there have been provided several designs effective for supporting personal computer equipment for use by an operator. Nevertheless, there are needs of convenience, versatility, efficiency and security which remain unmet by these prior devices. Where one's work task requires at times the use of a conventional desk, with its flat top, and at other times the operation of desk top computer equipment, it is necessary to provide both a computer desk or table as well as a conventional desk. This represents an added space requirement. The inefficient use of space is compounded by the fact that conventional desks, particularly large ones, typically have a space at its central rear portion which is essentially unusable dead space. There is also a need to provide better ways for preventing unauthorized access to computers and for securing expensive computer equipment against theft.

SUMMARY OF THE INVENTION

In view of the foregoing, it is an object of the present invention to provide a desk which can have the configuration of a computer work station and which, as desired, can be quickly and easily converted to have the configuration of a conventional desk.

Another object is to reduce the number of structures required in a work space for supporting personal computer equipment.

A still further object is to more efficiently use a desk structure by utilizing the rear, central part of the space occupied by a desk.

These and other objects and advantages are achievable by the present invention which provides a computer desk construction which can have the configuration of a conventional flat-topped desk or a configuration in which a monitor and related equipment lie at the desk top and an ergonomically positioned keyboard is exposed.

The inventive desk structure includes a pair of upright, spaced-apart support walls that extend from the front to the rear of the desk, and a keyboard support shelf extending between upper forward parts of the spaced apart walls. There is an equipment storage compartment to the rear of the desk, between rear portions of the spaced apart walls and having at least a horizontal bottom wall. Elevation means mounted on the compartment bottom wall holds an equipment supporting platform horizontally and is operable to raise the platform from low within the compartment to a raised position adjacent the top of the spaced-apart walls. The invention features a desk-top portion that has first and second rectangular panels that are slidably mounted to track means provided on the upper portions of the spaced-apart walls. The track means includes a first, branched track having an upper channel that extends horizontally from front to rear of the spaced-apart walls, and the first desk-top panel has a plurality of support pins depending from its sides for slidably engaging this upper channel so as to move fore and aft therealong. The branched track has a lower, parallel channel, extending rearwardly from the front of the support walls and having a rear end portion that curves upwardly to join the mid portion of the upper channel. The track means includes a second track with a major portion lying parallel to and below the level of the first track and extending forward from the rear of the support walls with a rear end portion that curves rearwardly and upward to level off at a somewhat higher elevation than the major portion of the second track. The second desk-top panel having a first track-engaging means for supporting its forward portion and a second track-engaging means for supporting its rear portion. The desk has a flat-top configuration in which the desk-top panels abut each other and span the depth of the desk, with the equipment platform in its lowered position, the second panel covering the top of the equipment compartment and the first panel covering the keyboard shelf, and with the forward portion of the second panel supported on the upper channel and its rear portion supported on the rear portion of the second track. The desk has an operation configuration wherein the second panel has been slid to a lower position and the keyboard shelf is uncovered, and the equipment platform is in its raised position with the first panel abutting it.

BRIEF DESCRIPTION OF DRAWINGS

FIG. 4 is a sectional view taken along a vertical plane through the line 4—4 of FIG. 1;

FIG. 5 is a partial, enlarged sectional view illustrating positioning of desk-top panels;

FIG. 6 is a view similar to FIG. 5;

FIG. 7 is another view illustrating panel positioning;

FIG. 8 is an enlarged partial view showing one type of support pin mounted to a desk-top panel; and FIG. 9 is a similar view showing another type of support pin.

DETAILED DESCRIPTION OF INVENTION

Figure 1:
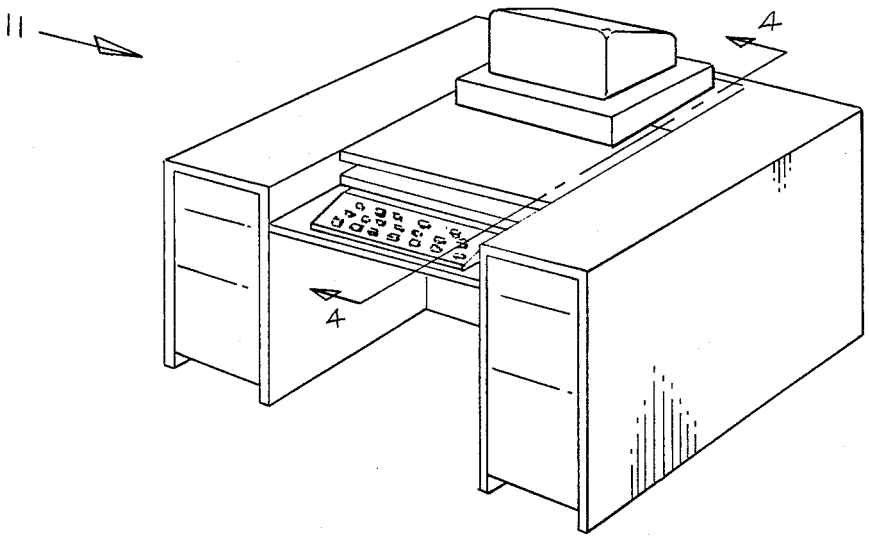
FIG. 1 is a perspective view of a desk according to the invention, in its flat-top configuration.
Figure 3:
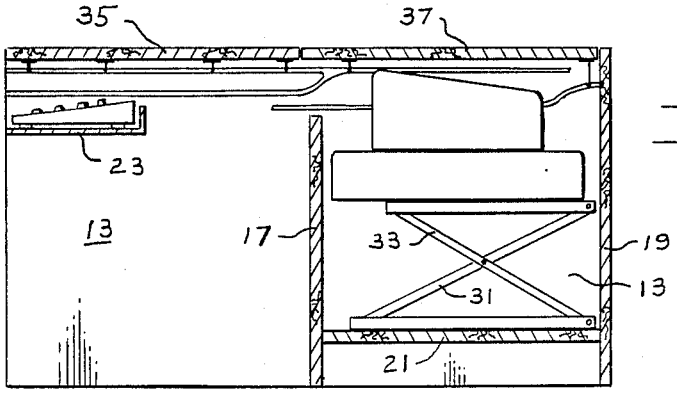
FIG. 3 is a sectional view taken along a vertical plane through the line 3—3 of FIG. 2.

Referring now to the drawings, FIG. 1 shows that a desk 11 constructed according to the invention includes first and second upright spaced-apart support walls 13 and 15, respectively; and as shown in FIG. 3, includes a mid-wall 17, a rear wall 19 and a bottom wall 21. These components and the general support structure of desk 11 are preferably fabricated of wood according to techniques generally known in the industry. It will be evident that computer desks according to the invention may also be made of metal. The drawings show a shelf 23 for supporting a keyboard K, which shelf is affixed at its sides to support walls 13 and 15 by suitable conventional means such as wood screws. Shelf 23 is spaced below the top of walls 13 and 15 at a height which is best suited for use of a keyboard from a human factor standpoint.

The walls 13, 15, 17, 19 and 21 form an equipment holding compartment in which a lift mechanism holds a piece of computer equipment such as module C. It will be seen that this compartment when covered with a desk-top panel in a manner to be described, will be quite effective for securing a piece of equipment C from theft and unauthorized access. The lift mechanism 25 is a conventional electrically powered unit featuring a screw-driven crossed spar mechanism, and is of the type commercially available under the tademark OPEN SESAME, and distributed by Hafele America, of High Point, North Carolina. Mechansim 25 includes a base 27 that is secured to bottom wall 21, and an upper horizontally supported support platform 29 that can be raised and lowered by the scissor-like manipulation of the spars 31 and 33. Switch means for controlling the lift mechanism 25 are preferably located within a securable compartment such as a conventional lockable drawer of desk 11. In a manner to be described, the mechanism 25 can be operated to raise platform 29 to a position level with the tops of support walls 13 and 15.

The desk-top portion of desk 11 features a first rectangular desk-top panel 35 and a second rectangular desk-top panel 37. The drawings also show a first, branched track 39 and a second track 41 which are adapted to support and guide these desk-top panels in sliding movement. In the preferred embodiment these tracks comprise slots or channels cut into walls 13 and 15 using conventional woodworking techniques. It will be evident that other types of track constructions are employable under the invention. For example in another preferred embodiment, conventional metal working techniques are used to cut the appropriate channels in steel plates that are affixed to support walls 13 and 15 by screws. The branched track 39 has an upper run 43 that extends horizontally from the desk front substantially towards the rear of walls 13 and 15. Track 39 has a lower run 45 which curves as shown to join the central part of the upper run 43. The second track 41 has a major horizontal run 47 which curves upwardly to a somewhat elevated rear portion 49.

The sides of first panel 35 are provided with a plurality of equally spaced apart pin units 51. FIG. 9 shows that one of these preferably metal pin units 51 comprises a screw-mountable bracket portion 53 and a support pin 55. The pins 55 of first panel 35 will slidably engage the channel 43 and a plurality of such spaced pins will ensure that panel 35 is confined to slide along the full extent of the upper run 43 and will not engage the curved channel portion 46.

The forward portion of second desk-top panel 37 is supported by a single pair of pin units 57 which are identical to units 51. It is noted that the rear portion of panel 37 is supported by a single pair of pin units 59, each having a bracket 61 which holds pin 63 at a spacing below panel 37. Pin 63 is adapted to slidably engage the second track 41.

Figure 2:
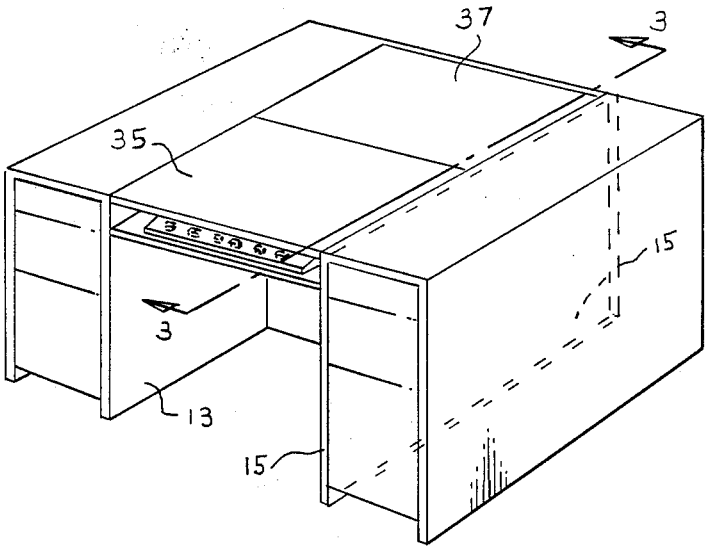
FIG. 2 is a perspective view showing the desk of FIG. 1 in configuration for computer operation.

When the top of desk 11 has the flat configuration shown in FIG. 2, the panel 37 has been moved fully rearward with its pin unit 59 riding the elevated rear portion 49 of track 41, and with its forward pin units 57 engaging the upper run 43 at a location behind the curve 46. Thus panels 35 and 37 may cover and conceal the keyboard K and the computer module C in the equipment compartment.

When it is desirable to convert desk 11 for operation of the computer equipment, the panel 35 is first moved somewhat forward as illustrated in FIG. 5. This will provide space to allow panel 37 to be then slid forwardly so that its forward pin unit 57 will engage the curve 46 and be directed into the lower run 45. This forward movement of panel 37 will also lower its rear pin units 57 into the major run 47, and allow both panels to be brought forward as shown in FIG. 6, with panel 37 below panel 35. With the panels in this intermediate position the lift mechanism 25 may then be activated to raise the platform 29 and module C to the position shown in FIG. 7. The conversion is completed by then urging the panel 35 rearward into contact with platform 29 and moving panel 37 rearward to uncover the keyboard shelf 23. FIG. 4 shows this configuration.

A preferred embodiment has been described and it should be appreciated by those with ordinary skill in the art, that within the scope of the invention various changes may be made. For example a desk according to the invention may use desk-top panels having roller elements for engaging tracks adapted to guide those roller elements, instead of the pin-and-channel arrangements of the preferred embodiment. This it is aimed to cover all changes and modifications as fall within the true spirit and scope of the invention.

What is claimed is:

1. Convertible computer desk including:

(a) first and second upright, horizontally spaced-apart support walls, extending from the front of said desk to the rear of said desk;

(b) support shelf for a keyboard, extending between upper, forward parts of said support walls;

(c) equipment storage compartment having walls that include rearward portions of said spaced-apart support walls and a generally horizontally bottom wall;

(d) equipment supporting platform mounted to elevation means affixed to said compartment bottom wall, said elevation means holding said platform horizontally and operable to move said platform vertically from a position low within said compartment to a raised position adjacent the top of said support walls;

(e) desk top portion comprising first and second rectangular panels which are slidably mounted to track means affixed to upper portions of said spaced-apart support walls, said track means including a first, branched track that has an upper channel that extends horizontally from the front of said support walls towards the rear of said desk, said first desk-top panel having a plurality of support means depending from its sides for engaging said upper channel to slidably support said first panel for fore and aft movement therealong, said branched track having a lower parallel channel, extending rearwardly from the front of said support walls and having a rear end portion that curves upwardly to join the mid portion of said upper channel, said track means including a second track with a major portion lying parallel to and below the level of said first track and extending forward from the rear of said support walls with a rear end portion that curves rearwardly and upward to level off at a somewhat higher elevation than the major portion of said second track, said second desk-top panel having a first track engaging means for supporting the forward part of said second panel and a second track engaging means for supporting the rear part of said second panel; said desk having a flat top configuration in which said first and second panels abut each other and span the depth of said desk, with said platform in its lowered position and said second panel covering the upper opening of said compartment and said first panel covering said keyboard shelf, and with the forward part of said second panel supported on said upper rail and its rear part supported on the rear portion of said second track; said second panel being slidable forwardly to a lower horizontal position generally below said first panel so as to uncover the upper opening of said compartment, with the front of said second panel supported by the lower channel of said first track and the rear of said second panel supported by the major part of said second track; said desk having an operational configuration wherein said equipment platform is in its raised position and said first panel is slid rearwardly to abut said platform and said second panel is slid rearwardly from its forward lower position to uncover said keyboard shelf.

2. Desk as defined in claim 1 wherein said equipment compartment includes a forward wall and a rear wall.

3. Desk as defined in claim 2 wherein the plurality of support means for said first desk-top panel includes a plurality of spaced-apart horizontal pins and the first track engaging means of said second panel includes a first pair of pins extending horizontally from opposite sides of said second panel and the second track engaging means includes a second pair of pins extending horizontally from opposite sides of said second panel.

* * * * *